United States Patent [19]

Lynch

[11] 4,368,722

[45] Jan. 18, 1983

[54] DEVICE AND METHOD FOR CONVERTING WOOD INTO THERMAL ENERGY

[76] Inventor: Richard A. Lynch, 9009 Conservation, N.E., Ada, Mich. 49301

[21] Appl. No.: 66,645

[22] Filed: Aug. 15, 1979

[51] Int. Cl.[3] ..... F24C 1/14

[52] U.S. Cl. ..... 126/77; 126/58; 126/83; 126/79; 126/242

[58] Field of Search ..... 126/242, 83, 77, 58, 126/15 R, 15 A, 21 R, 21 A, 79, 123, 99 D, 112, 290; 98/119

[56] References Cited

U.S. PATENT DOCUMENTS

| | | | |
|---|---|---|---|
| 82,637 | 9/1868 | Redway . | |
| 327,336 | 9/1885 | Smith . | |
| 331,455 | 12/1885 | Smith . | |
| 529,224 | 11/1894 | White | 126/290 |
| 610,260 | 9/1898 | Cutler . | |
| 651,667 | 6/1900 | Knauss | 126/290 |
| 656,978 | 8/1900 | Howard | 126/83 |
| 740,674 | 10/1903 | March | 126/290 X |
| 938,543 | 11/1909 | Anthony | 126/77 |
| 974,290 | 11/1910 | Merritt | 126/77 |
| 1,108,944 | 9/1914 | Tannenbaum | 126/242 |
| 1,920,817 | 8/1933 | Van Woert . | |
| 2,184,813 | 12/1939 | Knight . | |
| 2,444,402 | 6/1948 | Klein | 126/287 |
| 3,085,491 | 4/1963 | Ross | 98/119 |
| 4,196,713 | 4/1980 | Smith et al. | 126/83 |

FOREIGN PATENT DOCUMENTS

| | | | |
|---|---|---|---|
| 589074 | 5/1925 | France | 126/83 |
| 101988 | 12/1963 | Norway | 126/83 |
| 128863 | 7/1940 | Sweden | 126/65 |

*Primary Examiner*—Larry Jones

*Attorney, Agent, or Firm*—Price, Heneveld, Huizenga & Cooper

[57] ABSTRACT

A device and method for burning wood for the purpose of heat generation is disclosed. The device has a flat grate on which the fuel is placed and a vertical combustion air inlet passage which discharges the air as a wide, flat ribbon at one end of the combustion chamber substantially at the top surface of the grate. Combustion is confined to a zone which progressively moves along the grate away from the air unit. The combustion gases are collected at the top of the combustion chamber which is arched and arranged to cause them to spiral and while still in the combustion chamber and at autogenic temperature to mix with additional, partially heated air to complete the combustion process. The exhaust route for the combustion gases is elongated and doubled back upon itself to delay discharge and allow sufficient time to effectively heat exchange with the thermal energy transport and distribution medium.

8 Claims, 10 Drawing Figures

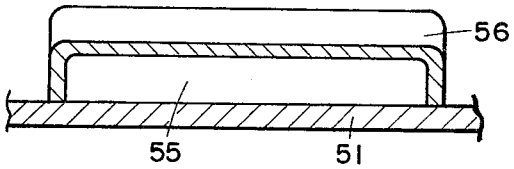
FIG 8
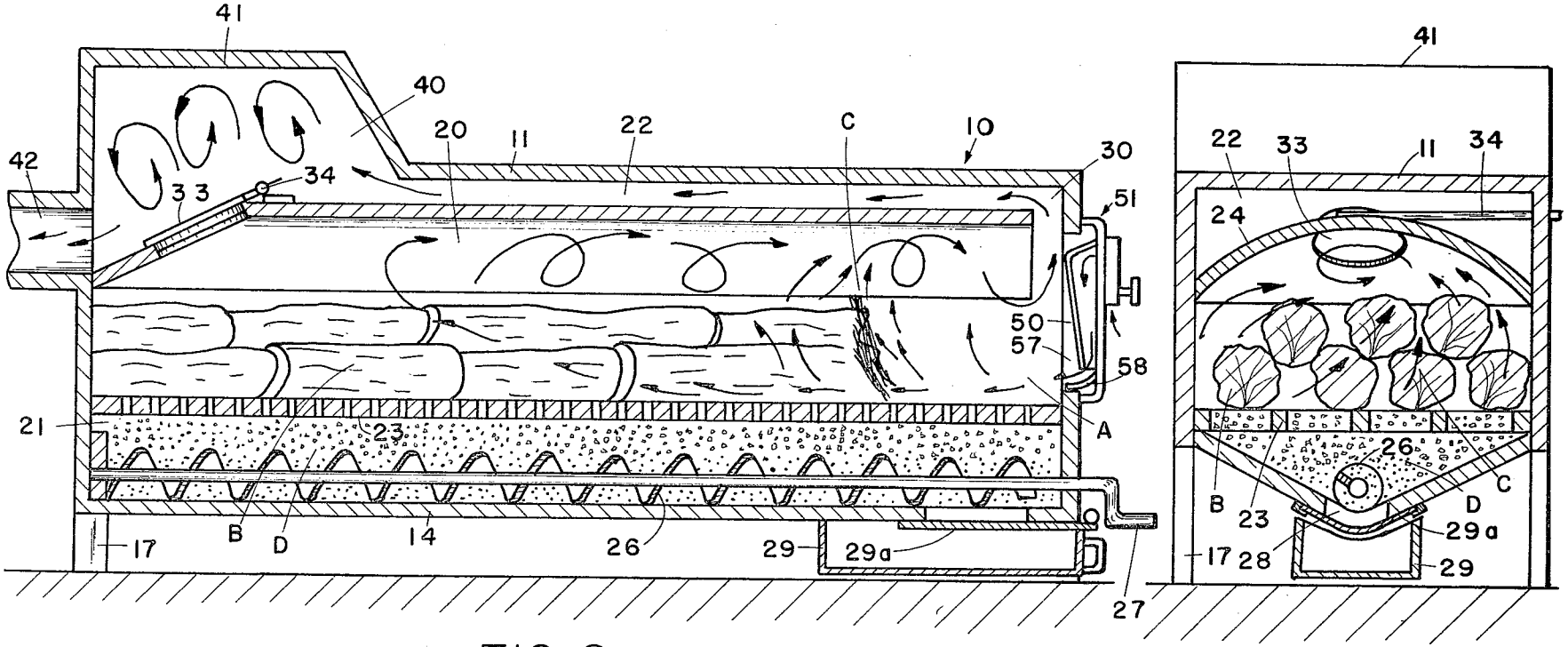
FIG 9
FIG 10

DEVICE AND METHOD FOR CONVERTING WOOD INTO THERMAL ENERGY

BACKGROUND OF THE INVENTION

This invention pertains to wood burning devices including both stoves and furnaces. Its particular objective is to increase the efficiency and the safety of such devices.

It has long been recognized that wood, particularly well-seasoned, dry hardwood, contains a very substantial potential of thermal energy which can be released by burning. Among the various problems which have been encountered in the use of wood in stoves and furnaces as a thermal energy source is the fact that the wood tends to burn rapidly with the consequent release of more thermal energy than that which can be effectively heat exchanged into a useful or distribution medium such as air or water. Thus, a substantial portion of the fuel's potential energy is lost through the exhaust stack or flue. Various techniques have been utilized to try to overcome or at least reduce this problem. One technique which has been utilized is that of providing a long and tortuous path for the products of combustion. The principle involved in this approach has been that of providing an increased time lapse during which thermal energy can be effectively exchanged from the hot combustion gases to the usable or distribution medium. A second technique has been that of using so-called "starved air" combustion. This technique involves the restriction of the amount of air and thus oxygen available in the combustion chamber to slow the rate at which the wood burns.

Both of these approaches have produced some degree of success. However, they have also created additional problems. The use of the so-called "starved air" combustion results in incomplete combustion of many of the volatile hydrocarbon constituents of the wood. Coolectively, these constituents, when they become deposited, are referred to as creosote. Creosote is a complex of aromatic hydrocarbons including tar acids, tar bases and phenols. Many of these constituents become deposited on the surfaces through which the flue gases pass if the flue gas temperature drops below about 200° F. These deposits build up and both tend to clog and thus interfere with the movement of gases through the flue. Also, being flammable, creosote has a tendency to catch fire resulting in so-called chimney fires. This problem is compounded by the use of long and tortuous flue passages when this results in thermal transfers which reduce the temperature of the gases below that at which creosote deposit occurs. This problem is more acute in winter and in exposed exterior chimneys, particularly the new metal chimneys because of their relatively high heat transfer characteristics. Thus, the two approaches which have been used heretofore to increase efficiency have combined to also increase the first hazard and to complicate the problem of keeping the flues open and effective.

BRIEF DESCRIPTION OF THE INVENTION

This invention involves the discovery that by changing the manner in which the air is introduced to the combustion zone and coupling this with restricting the actual combustion to a limited area within the combustion zone, it is possible to avoid the problem of excessive creosote deposit and at the same time accurately control the rate of combustion so that the thermal energy release is at a rate more generally proportional to the thermal demand. The invention permits the elongated path of combustion gases to be utilized for efficient thermal transfer without the undesirable side effect of significant creosote deposit. In this connection, a combustion air inlet or draft control has been developed which introduces the combustion air as a relatively thin film moving parallel to the plane of the top surface of the burning grate and substantially at the level of the burning grate. By this, the zone of actual combustion is confined to an area which represents the interface between the entering combustion air at the grate level and the wood which extends rearwardly in the combustion chamber away from the source of combustion air. In this manner, an intense, high temperature combustion occurs at the interface but the chemical reaction which constitutes combustion is limited to a narrow, confined zone which progresses rearwardly through the combustion chamber from front to rear. In this manner, high temperature gases are produced to provide effective thermal transfer but, at the same time, the rate at which the wood is consumed is limited because the actual area in which combustion occurs is comparatively small. The principle by which these objectives are accomplished will be understood by reading the following drawings and the accompanying description.

BRIEF DESCRIPTION OF THE DRAWINGS

FIG. 8 is a sectional view taken along the plane VIII—VIII of FIG. 6;

FIG. 9 is a sectional elevational view similar to FIG. 1 but illustrating the invention in operation; and FIG. 10 is a sectional elevational view similar to FIG. 2 but illustrating the invention in operation.

DESCRIPTION OF THE PREFERRED EMBODIMENT

Figure 1:
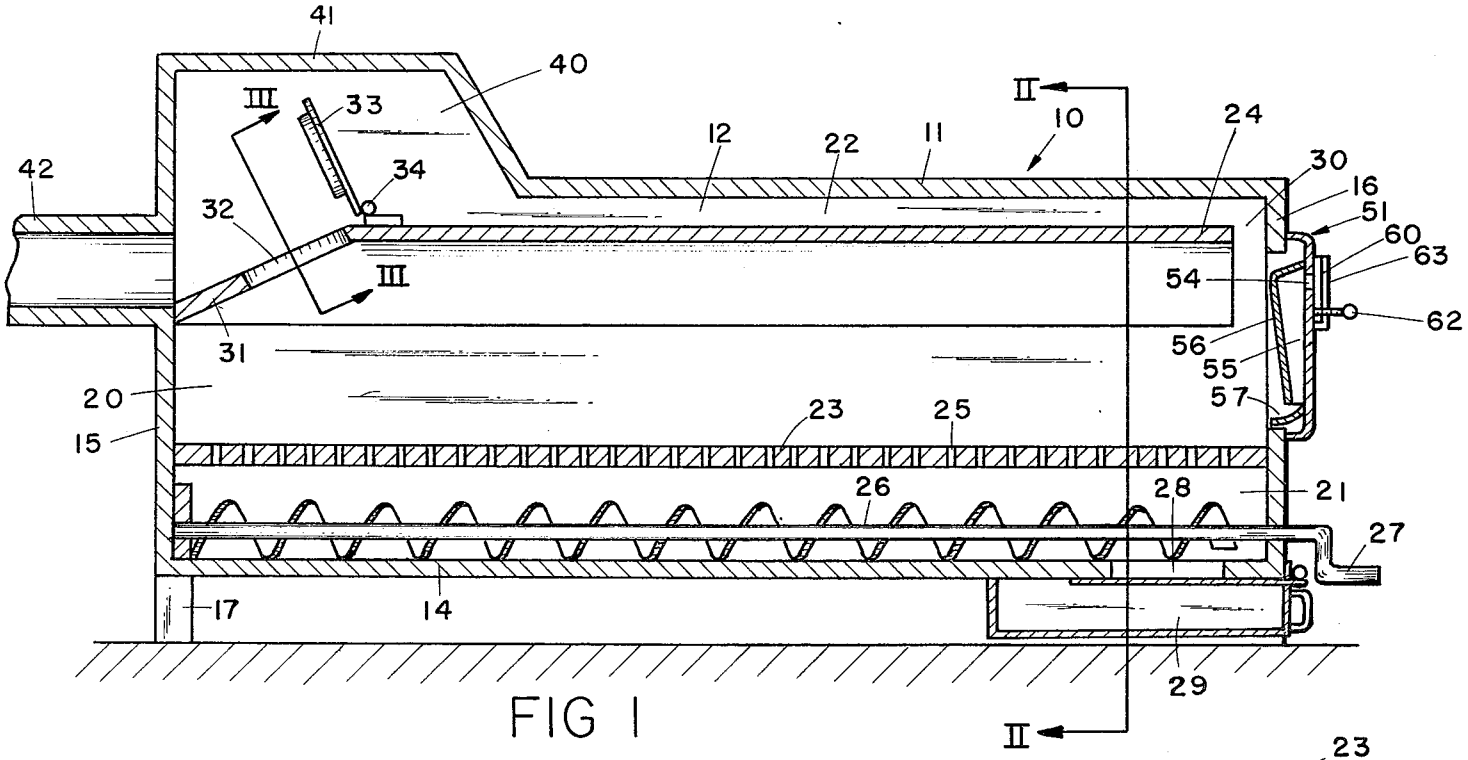
FIG. 1 is a sectional, elevational view of the invention taken along the plane I—I of FIG. 2.
Figure 7:
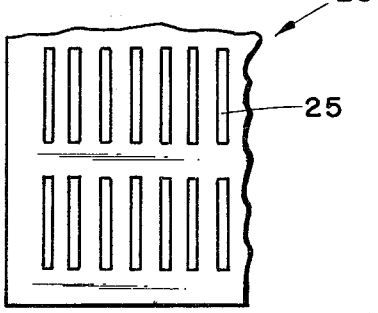
FIG. 7 is a fragmentary, plan view of the grate for the combustion chamber.

In the following description, the invention is disclosed as applied to a stove. This is the invention applied in its simplest and most elemental form. It will be recognized that the entire stove structure as illustrated and described could be enclosed in a jacket providing an exterior air passage to serve as a heat exchange chamber or the essential elements of the invention could be applied as a combustion chamber for a furnace either providing heat exchange with air as a result of appropriate jacketing or with water or other liquid by means of pipes incorporated in the combustion chamber walls for heat exchange purposes. These various applications do not change the principles of the invention about to be described.

The numeral 10 indicates a shell having a top 11, a pair of sides 12 and 13, a bottom 14, a back 15 and a front wall 16. The shell is supported on suitable legs 17 at both front and back. A preferable material for the shell is either heavy sheet steel or cast iron plates, preferably joined by welding to provide an air tight interior compartment except for necessary access openings intentionally provided. The interior enclosure created by the shell 10 is divided into a combustion chamber 20, an ash chamber 21 and a heat exchange flue 22. The combustion chamber and the ash chamber are separated by a grate 23. The heat exchange flue 22 and the combustion chamber 20 are separated by a baffle 24.

The grate extends from side to side and from front to rear. It is flat and horizontal. It is characterized by a large number of small openings 25 of a size which will readily pass the fine ash resulting from the complete combustion of wood but will not pass unburned wood, thus retaining the wood on the surface of the grate until it has been completely consumed. As will be explained subsequently, the openings through the grate do not serve as inlets for combustion air. Thus their only purpose is to provide an escape for the ash resulting from combustion.

Figure 2:
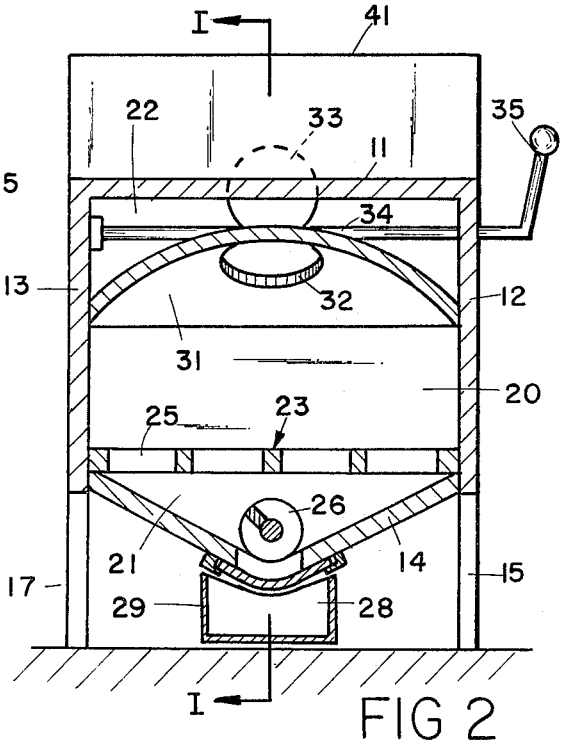
FIG. 2 is a sectional, elevational view taken along the plane II—II of FIG. 1.
Figure 6:
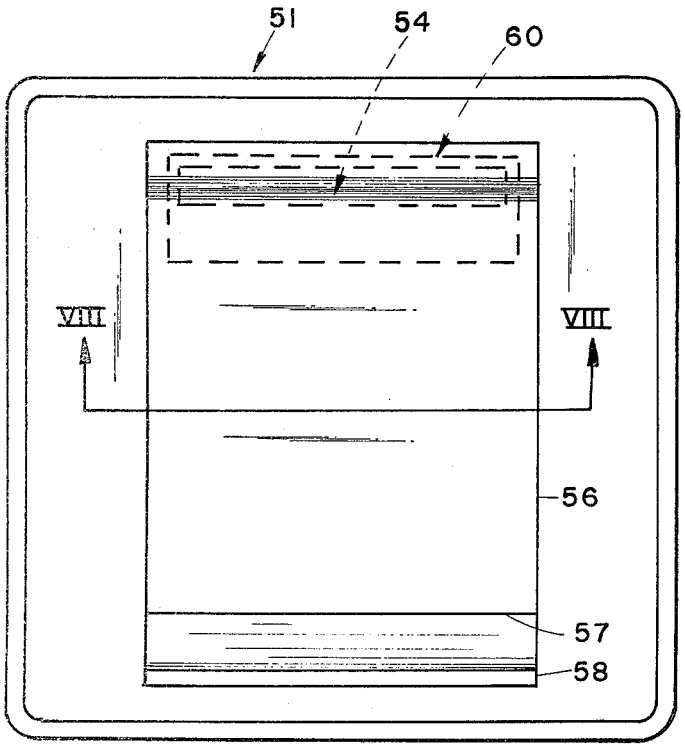
FIG. 6 is an inside view of the door equipped with the draft control.

As will be seen from FIG. 2, the bottom 14 is shaped in the form of a shallow "V" with the top edges secured at the sides at or almost at the lower face of the grate 23. This shallow V forms a trough inducing the ash to collect at the center where it can be periodically moved forward by manipulation of the helical conveyor or auger 26. The conveyor is operated by means of a crank 27 at the front of the stove. The conveyor discharges the ashes through the opening 28 into a collector tray or pan 29. When the pan 29 is not present, the opening 28 is closed by the sliding shutoff 29*a*. The pan 29 is shaped to fit closely under the bottom of the unit. This prevents ash spill and controls ash dust getting into the air.

Figure 3:
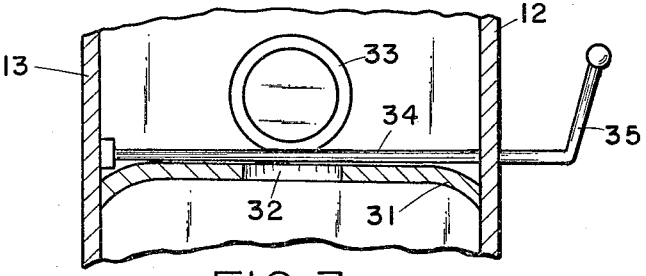
FIG. 3 is a fragmentary, sectional view taken along the plane III—III of FIG. 1.
Figure 4:
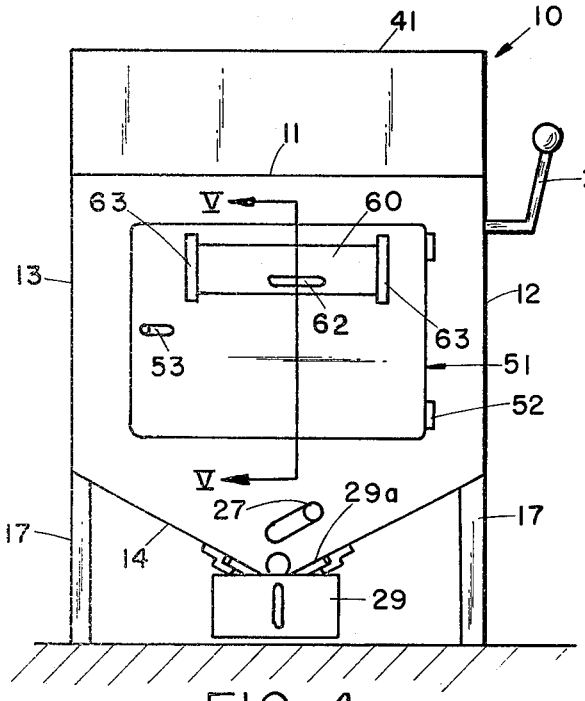
FIG. 4 is a front elevational view of the stove illustrated in FIG. 1.

The baffle 24 is arched to provide a convex roof for the combustion chamber (FIGS. 2 and 10). It extends forwardly to a point adjacent the front wall 16 of the combustion chamber from which it is spaced a short distance to create the restricted throat 30. The rear portion of the baffle is sloped downwardly and rearwardly to form a flat combustion chamber roof plate 31 which seals the rear end of the combustion chamber from the exhaust gas passage except for the draft opening 32. A damper 33, pivotally mounted at its upper, forward end, is provided for selectively closing the draft opening 32. The position of the damper is controlled by an actuator rod 34. The outer end of the rod projects through the sidewall and is equipped with a handle 35 (FIGS. 3 and 4).

The throat 30 discharges into the heat exchange passage 22 which in turn, at its rearward end, discharges into the heat exchange chamber 40. The chamber 40 is really an enlarged portion of the passage 22 and is formed by offsetting the top of the shell upwardly to form a dome 41. This provides a holding chamber for the hot combustion gases before they are finally exhausted to the stack. Exhausting of the gases to the chimney occurs through the pipe 42. The bottom of the pipe 42 is located at the top face of the roof plate or partition 31 where it contacts the rear wall 15 of the shell. It will be noted from FIG. 1 that the top of the pipe 42 is at or below the bottom surface of the passage 22 at the passage's narrowest vertical cross section. Thus, for the combustion gases to exit from the stove it is necessary that they pass downwardly, a type of movement which is resisted since the gases are heated and, therefore, tend to rise. The location of the pipe 42 thus serves as an additional gas retaining device to increase the time period during which the gases are in heat exchange relationship with the exterior surfaces of the stove. As a result of the closely controlled combustion rate made possible by this invention, the volume of combustion gases generated is significantly less than that of conventional wood burning devices of similar b.t.u. rating. Because of this the size of the pipe 42 can be materially less than that normally required.

Access to the combustion chamber is provided by an opening 50 through the front wall 16. This opening is normally closed by a door 51 mounted in a conventional manner by hinges 52 and secured by a latch 53 (FIG. 4). Near the upper edge of the door and stretching a substantial portion of the width of the door is a vertically narrow draft opening 54. The opening 54 communicates with a draft passage 55 created by the partition 56. The partition 56 forms a closure at the top, at the sides and along the inner side and thus is open to the combustion chamber only at the bottom through the restricted draft port 57. The draft port 57 is adjacent the lower end of the door, extends the full width of the partition 56 and thus extends a substantial portion of the width of the door 51. Immediately below the draft port 57 is a curved partition or baffle 58 which extends downwardly and inwardly and terminates at and just above the front edge of the grate 23. Thus, any combustion air being drawn into the combustion chamber through the draft port 57 is directed inwardly and discharges as a generally flat, horizontal ribbon A (FIG. 9), something akin to a layer or film or air immediately above the grate. Being relatively cold with respect to the air within the combustion chamber it tends initially to sink against the grate and thus flow along the top surface of the grate rearwardly toward the point of combustion.

Figure 5:
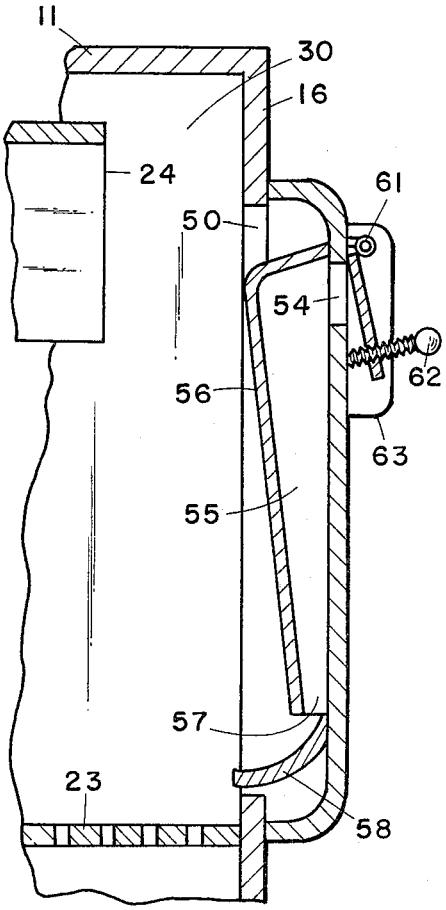
FIG. 5 is an enlarged, fragmentary, sectional view of the draft control mechanism for the combustion chamber taken along the plane V—V of FIG. 4.

The draft intake opening is covered by a draft control plate 60 which is mounted at its upper edge to the door by a hinge 61. It is important that the size of the plate is such that its lower edge extends well below the lower edge of the draft intake opening 54 as is shown in FIG. 5. The pivotal position of the plate can be controlled by any suitable means which will permit precise, that it microadjustment, of the volume of air which can enter the draft opening. In the illustrated embodiment, this is accomplished by means of the threaded control member 62 which makes threaded engagement with the plate 60 and has its inner end bearing against the surface of the door 51. By rotating this control, the plate 60 can be pivoted inwardly or outwardly and the position can be determined within a very narrow range to provide exactly the amount of air desired for proper combustion. A pair of wings 63 are provided, one on each side of the plate 60. These serve as shields to prevent air disturbances in the vicinity of the door from disturbing the in-flow pattern of the air entering the draft opening 54. The downward extension of the plate 60 below the bottom of the intake opening 54 also serves the same purpose, thus isolating the combustion chamber from variations in the volume of draft air which might result from air currents in the air ambient to the stove.

To operate the stove, the combustion chamber is provided with the supply of wood B as indicated in FIGS. 9 and 10. As initially charged, most of the chamber is occupied by the wood which extends all the way to the back of the chamber. Before supplying wood to the chamber, if the stove has been in use the remaining hot coals should be raked to the forward end of the combustion chamber. In so doing, the ash level on the grate should be reduced to no more than a thin film by operation of the auger 26 and lightly raking the top of the grate 23 to cause ashes on the grate to pass through into the ash chamber 21 below. The wood is introduced over the coals through the opening 50 while the door 51 is open.

When the door 51 is open, the damper 33 is open to eliminate smoke or ash dust escape through the door opening. The damper 33 is also opened when the auger 26 is operated to discharge ashes into the tray 29. Again the purpose is to induce an inflow of air which will prevent ashes from escaping into the room. At all other times the damper 33 is closed.

Once the supply of wood has been deposited in the chamber, the wood is ignited at the front of the chamber by any conventional means, a number of which are well known to those who are acquainted with the operation of a wood stove or furnace. Once the fire has become established a combustion front or zone such as the area C in FIG. 9 is established, the draft control plate 60 is adjusted to admit just enough air to maintain a high temperature, low flame combustion reaction at the front of the wood or combustion zone C.

The air admitted through the draft opening 54 moves down the passage 55 and is directed as a film or ribbon A into the area immediately above the grate surface. After its discharge from the draft port 57, it is pulled rearwardly by the demand of the fire front or combustion zone C. Most of the air enters the combustion zone and is utilized and the resulting hot gases or combustion products move upwardly to the top of the combustion chamber. Some of these combustion products move upwardly and rearwardly to a point well rearward of the fire front or combustion zone. Also, some of the air, particularly that immediately adjacent the sides of the combustion chamber, also moves rearwardly. These gases being hot or, in the case of the gases which have not passed through the combustion zone, having become heated, rise to the top of the chamber. There, due to the convex curvature of the baffle 24 forming the roof of the chamber, these gases are induced to spiral and are drawn forwardly to the throat 30. As the gases from the rearward portion of the chamber spiral forwardly, they pick up extremely hot gases from the fire front or combustion zone. These gases contain a significant quantity of volatile hydrocarbon constituents which have not been burned. The gases which are discharged from the actual combustion area are at a temperature high enough that when mixed with the other gases containing these unreacted hydrocarbon constituents and additional oxygen will produce autogenic or secondary combustion in the spiraling gases moving forwardly along the top of the combustion chamber. This burning continues at least to the point where the gases exit through the throat 30 and, if a combustible mixture of gases is present, may continue in the heat exchange passage 22.

As the combustion gases pass rearwardly through the passage 22, a significant quantity of their thermal energy is exchanged with the exterior walls of the shell 10 which in turn transfer the heat to the ambient atmosphere immediately adjacent the shell. In this manner, useful thermal energy is extracted from these gases. The gases discharge from the passageway 22 into the chamber 40 where, as indicated by the arrows D, the gases spiral and circulate and because of their high temperature tend to collect against the top of the dome 41. The existence of this chamber serves to reduce the velocity of movement of the gases not only toward the exhaust stack 42 but also through the passage 22. In this manner, the gases are retained in heat exchange relationship with the shell longer than would otherwise be true, permitting a greater proportion of their thermal energy to be transferred where it can be utilized. A further delaying factor in the final discharge of the gases is the location of the stack opening 42 at the bottom of the chamber 40. Since this is located at the bottom of the chamber and below a major portion of the passage 22, the gases are induced to enter the exhaust member 42 more by being pushed down into it than being pulled rapidly through the chamber by a combination of being pushed by gases attempting to exhaust from the combustion chamber and pulled by gases rising through the chimney stack. The combined effect of the various features of this invention is to increase the residency time for the combustion gases within the stove from five to ten times that of conventional wood burning stoves.

In addition to the heat exchanges which have already been described, the sidewalls of the combustion chamber, being exposed directly to the radiant heat incident to the actual combustion zone and to the extremely high temperature gases produced in this zone become a further source of heat transfer and thus of radiant energy at the exterior of the stove. Long before the fire front C reaches the back wall 15 of the shell, it will be found that the entire shell is warm. In fact, it has been found that a characteristic of this stove is that the rear portions of the sidewalls 12 and 13 and the back wall 15 of the stove are effective heat exchange surfaces. This makes the stove more efficient as a thermal energy source than stoves of conventional construction where only small portions of the sidewalls become hot enough during combustion to serve as effective heat exchange surfaces.

It will be understood from the preceding description that this invention does not employ the "starved oxygen" concept of combustion control. In fact, sufficient oxygen is admitted to assure combustion of the volatile hydrocarbons released at the interface combustion zone including those which become part of the hot combustion gases and rise to the top of the combustion chamber. There, additional amounts of the combustion air which have become heated, rise and separate from the main ribbon or layer of combustion air moving toward the interface combustion zone mix with these hot volatile hydrocarbon materials and there, by reason of the high temperature, react to support secondary combustion By reason of the construction of the combustion chamber and the method by which the combustion air is introduced, this invention avoids the problems which have been experienced with the introduction of what is termed "secondary combustion air". In the secondary combustion air method, substantial quantities of secondardy combustion air are introduced, normally in a separate combustion zone. Usually such air is introduced in substantial quantities and at relatively low temperatures. This results in lowering the temperature of the combustion gases below the autogenic temperature of the volatile hydrocarbons, resulting in secondary combustion failing to occur in the absence of the introduction of secondary fuels to enrich the mixture to that which will support combustion at a much lower temperature. Such secondary fuels normally include gas or fuel oil.

This invention provides gradual introduction of the air and limits the quantity of air to that sufficient to assure combustion without lowering the temperature of the gases below that at which the mixture is autogenic. The result is substantially complete combustion. As a result, the combustion gases which are introduced into the exhaust stack 42 and thus into the chimney or flue, will not deposit significant quantities of creosote, even though a major portion of the thermal energy has been extracted from the gases before they enter the chimney. In this manner, this invention not only reduces fire hazard but in two ways materially increases thermal efficiency. First, in the effective burning of the volatile gases along the top of the combustion chamber additional quantities of thermal energy are released so that more of the thermal energy potential of the wood fuel is made available. Secondly, because the ultimate gas discharged from the combustion chamber is relatively free of unburned, volatile hydrocarbons, the gases can be released into the chimney at a lower temperature without inducing significant creosote deposits in the chimney. In this connection, the arched construction for the roof of the combustion chamber is important because it induces the formation of the spiraling path of the gases as they travel forwardly in the combustion chamber. This gas pattern has a dual purpose. It provides a more thorough mixing of the hot combustion gases and the additional air supply rising from the film of combustion air at the grate. Since combustion can only occur when there is actual contact between oxygen and the hydrocarbon constituents in the combustion gases, mixing is important to effective and thorough reaction between the two. Also, this spiraling path effectively lengthens the period of time the gases remain in the combustion chamber. Thus the gases are confined within a high temperature zone where they are retained at autogenic temperatures for a period long enough to permit the combustion process to be carried out and completed. By providing the flue 22 between the baffle 24 and the heat exchange surface 11 at the top of the shell, the baffle is maintained at a very high temperature and thus does not withdraw significant quantities of thermal energy from the spiraling gases permitting them to complete the chemical reaction necessary for combustion.

Another important factor in controlling the combustion process in this stove is the ash collection chamber 21. For proper operation of the unit this chamber is kept full of ash as indicated at D in FIGS. 9 and 10. In fact, it has been found that a thin layer, such as a half-inch, of ashes on the top of the grate does not interfere with the proper operation of the combustion chamber. By keeping the ash chamber 21 full, the introduction of air upwardly through the grate is prevented. This is important in effectively maintaining the draft air flow as a wide film near the top of the grate surface. The auger 26 is used only to remove enough ashes to prevent excessive build up above the grate.

The practice of maintaining a full ash chamber also thermally insulates the bottom 14. This eliminates the danger of burn out of this panel. Thus, this is a marked improvement in safety.

From the above description, it will be recognized that this invention provides a material improvement in both equipment and in method of converting wood fuels into thermal energy. It will be recognized that modifications of the invention can be made which will not depart from the principles herein disclosed. Such modifications are to be considered as included within the hereinafter appended claims unless these claims by their language expressly state otherwise.

The embodiments of the invention in which an exclusive property or privilege is claimed are defined as follows:

1. A device for burning wood for the purpose of generating thermal energy, said device having a shell enclosing a front to back rectangular elongated chamber having a horizontal plate closing the top thereof, an elongated baffle secured to and forming a seal with the back and sides of said shell and dividing said chamber into a combustion chamber and an exhaust gas passage; the front and major portion of said baffle being parallel with said plate; the front end of said baffle being adjacent to and spaced from the front of said chamber to provide a restricted throat for movement of combustion gases from said combustion chamber into said passage and forming the only discharge opening for gases from said combustion chamber during normal firing mode; a horizontal perforate grate, an ash collecting chamber beneath said grate having means sealing it against entry of combustion air, means for introducing combustion air in controlled amounts into said combustion chamber, said means being the only inlet for combustion air for said combustion chamber and characterized in that it is elongated laterally of the combustion chamber and has a downwardly extending air passage having an elongated slot-like inlet port at the top and a downwardly opening outlet port at the bottom and a directional guide vane below and adjacent to said outlet curved to extend inwardly and discharge rearwardly, the inner end of said vane being parallel to and substantially in the same horizontal plane as to the top of said grate; said outlet port and said vane extending a major portion of the width of the combustion chamber for discharging rearwardly parallel to and substantially the full width of the grate a ribbon-like stream of air substantially at the surface of said grate; a damper for closing said inlet port, adjustable means for controlling the position of said damper.

2. A device for burning wood as described in claim 1 wherein means are provided for shielding said inlet port against air currents in the adjacent ambient air, said means including a pair of forwardly projecting wings, one at each end of said damper and extending beyond both the top and bottom of said damper.

3. A device for burning wood for the purpose of generating thermal energy, said device having a shell enclosing a front to back rectangular elongated chamber having a horizontal plate closing the top thereof, an elongated baffle secured to and forming a seal with the back and sides of said shell and dividing said chamber into a combustion chamber and an exhaust gas passage; the front and major portion of said baffle being parallel with said plate; the front end of said baffle being adjacent to and spaced from the front of said chamber to provide a restricted throat for movement of combustion gases from said combustion chamber into said passage and forming the only discharge opening for gases from said combustion chamber during normal firing mode; a horizontal perforate grate, an ash collecting chamber beneath said grate having means sealing it against entry of combustion air, means for introducing combustion air in controlled amounts into said combustion chamber, said means being the only inlet for combustion air for said combustion chamber and characterized in that it is elongated laterally of the combustion chamber and has a downwardly extending air passage having an elongated slot-like inlet port at the top and a downwardly opening outlet port at the bottom and a directional guide vane below and adjacent to said outlet curved to extend inwardly and discharge rearwardly, the inner end of said vane being parallel to and substantially in the same horizontal plane as to the top of said grate; said outlet port and said vane extending a major portion of the width of the combustion chamber for discharging rearwardly parallel to and substantially the full width of the grate a ribbon-like stream of air substantially at the surface of said grate; a plate-like damper for closing said inlet port, adjustable means for controlling the position of said damper; means for shielding said inlet port against air currents in the adjacent ambient air.

4. A device for burning wood as described in claim 3 further characterized in that said damper is pivotally supported along its upper edge for swinging movement; said shielding elements being located at each end of said damper plate and projecting forwardly from said device.

5. A device for burning wood as described in claim 3 further characterized in that an elongated damper is provided covering said inlet port, said damper being hingedly supported at its upper edge; said shielding means being walls at each end of said damper closing the sides of the opening formed by said damper when it is moved to open said inlet, said damper extending substantially below the lower edge of said inlet opening for creating a tortuous path for air entering the inlet whereby the rate of flow of air through the inlet is rendered substantially constant.

6. A device for burning wood for the purpose of generating thermal energy, said device having a shell having a front, back, sides, top and bottom enclosing a front to back elongated chamber, said top and bottom being horizontal; an elongated baffle secured to and forming a seal with back and sides of said shell and dividing said chamber into a combustion chamber and an exhaust gas passage, the front and major portion of said baffle being parallel to said top; the front end of said baffle being adjacent to and spaced from the front of said chamber to provide a restricted throat for movement of combustion gases from said combustion chamber into said passage, said throat forming the only discharge opening for gases from said combustion chamber during normal firing mode; a horizontal perforate element forming a combustion surface parallel with said baffle, an ash collecting chamber beneath said element and means in said element to permit the passage of ashes therethrough, said ash collecting chamber being sealed against the inlet of combustion air, a single inlet means for introducing combustion air in controlled amounts into said combustion chamber, said inlet means characterized in that it is elongated laterally of the combustion chamber and has a downwardly extending air passage having an elongated slot-like inlet port at the top and a downwardly opening outlet port at the bottom and a directional guide vane below and closely adjacent to said outlet port extending the full width thereof and curved to extend inwardly and discharge combustion air rearwardly, the inner end of said vane being parallel to and substantially in the same horizontal plane as to the top of said element; said outlet port and said vane extending a major portion of the width of the combustion chamber for discharging rearwardly parallel to and at the surface of said element a ribbon-like stream of combustion air; a damper for closing said inlet port, adjustable means for controlling the position of said damper.

7. A means for burning wood for the purpose of generating thermal energy, said means including a housing having front, back, side and top walls; a front to back elongated combustion chamber and an ash receiving chamber within said housing, an inlet for combustion air and a chimney opening for exhausting combustion gases through said back wall, a grate separating said combustion and ash chambers extending horizontally in a fore and aft direction, an element in said ash chamber for withdrawing ashes therefrom at the front end thereof, a baffle mounted in the upper portion of said housing and extending from side to side from the ear of said combustion chamber to a point adjacent to and spaced from said front wall, said baffle in a fore and aft direction being parallel to said grate, said baffle forming a seal with said side and back walls, a restricted combustion air exhaust port between the front end of said baffle and said front wall; a rearwardly extending gas exhaust channel between said baffle and said top wall, said exhaust channel being substantially horizontal for a major portion of its length; the rear portion of said baffle being downwardly sloped; the rearward end of said channel communicating with said chimney opening in said back wall; said chimney opening being below the upper portion of said exhaust channel; the top surface of said grate being substantially flat and said combustion air inlet including a vertically elongated enclosed air channel having an air inlet port at its upper end and an air discharge port at its lower end, said ports being vertically spaced, said discharge port being the only combustion air inlet for said combustion chamber and having a width substantially that of said grate and terminating in a laterally elongated, downwardly facing slot-like opening; a directional vane extending the width of said opening and positioned below and closely adjacent to it and to the top surface of said grate and shaped to direct a ribbon-like stream of air rearwardly into said combustion chamber substantially at, parallel to and substantially the full width of the top surface of said grate.

8. Means for burning wood as described in claim 7 further characterized in that said ash chamber laterally has a shallow V-shape, the bottom thereof being smoothly rounded; said element being an auger seated in said ash chamber; an ash discharge opening through the bottom of said chamber a closure element for said opening and adjacent the front thereof.

* * * * *